US007484596B2

(12) United States Patent
Aulanko et al.

(10) Patent No.: US 7,484,596 B2
(45) Date of Patent: Feb. 3, 2009

(54) ELEVATOR

(75) Inventors: Esko Aulanko, Kerava (FI); Jorma Mustalahti, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 11/106,618

(22) Filed: Apr. 15, 2005

(65) Prior Publication Data

US 2005/0224301 A1 Oct. 13, 2005

Related U.S. Application Data

(63) Continuation of application No. PCT/FI03/00818, filed on Nov. 4, 2003, and a continuation of application No. PCT/FI03/00714, filed on Oct. 1, 2003.

(30) Foreign Application Priority Data

Nov. 4, 2002 (FI) ..... 20021959
Jan. 31, 2003 (FI) ..... 20030153

(51) Int. Cl.
*B66B 9/02* (2006.01)
*B66B 11/04* (2006.01)
*B66B 11/08* (2006.01)

(52) U.S. Cl. ..... 187/266; 187/250; 187/251; 187/254

(58) Field of Classification Search ..... 187/251, 187/254, 264, 266, 406, 407, 410
See application file for complete search history.

(56) References Cited

U.S. PATENT DOCUMENTS 216,568 A * 6/1879 Holske ..... 187/251

(Continued)

FOREIGN PATENT DOCUMENTS

EP 0 631 968 B1 9/1996

(Continued)

OTHER PUBLICATIONS

International Search Report & International Preliminary Examination Report.

*Primary Examiner*—Peter M Cuomo
*Assistant Examiner*—Eric Pico
(74) *Attorney, Agent, or Firm*—Harness, Dickey & Pierce, P.L.C.

(57) ABSTRACT

An elevator without counterweight, in which elevator the elevator car is guided by guide rails and suspended by means of diverting pulleys on hoisting ropes so that the elevator has rope portions of the hoisting ropes going upwards and downwards from the elevator car and a number of diverting pulleys in the upper and lower parts of the elevator shaft. The elevator has a drive machine placed in the elevator shaft and provided with a traction sheave. The elevator has a compensating device acting on the hoisting ropes for equalizing and/or compensating the rope tension and/or rope elongation. Diverting pulleys are mounted on the elevator car near two side walls, and the rope portions from the traction sheave, from the diverting pulleys in the lower part of the elevator shaft and from the diverting pulleys in the upper part of the elevator shaft to the diverting pulleys mounted on the elevator car extend in a substantially vertical direction, and the rope portions connecting the rope portions from one side of the elevator car to its other side are rope portions between the diverting pulleys mounted near different side walls on the elevator car.

20 Claims, 5 Drawing Sheets

U.S. PATENT DOCUMENTS

| | | | | |
|---|---|---|---|---|
| 4,566,562 | A * | 1/1986 | Suzuki et al. | 187/266 |
| 4,624,097 | A * | 11/1986 | Wilcox | 57/232 |
| 5,899,300 | A * | 5/1999 | Miller et al. | 187/256 |
| 5,899,301 | A * | 5/1999 | Aulanko et al. | 187/266 |
| 5,931,265 | A * | 8/1999 | Hollowell et al. | 187/407 |
| 6,193,016 | B1 * | 2/2001 | Hollowell et al. | 187/250 |
| 6,193,017 | B1 * | 2/2001 | Koster | 187/258 |
| 6,401,871 | B2 * | 6/2002 | Baranda et al. | 187/254 |
| 6,491,136 | B2 * | 12/2002 | Kobayashi et al. | 187/254 |
| 6,513,792 | B1 * | 2/2003 | De Angelis | 254/374 |
| 6,596,098 | B1 * | 7/2003 | Nishida et al. | 148/320 |
| 6,640,935 | B1 * | 11/2003 | Murakami et al. | 187/401 |
| 6,722,475 | B2 * | 4/2004 | Miller et al. | 187/266 |
| 2001/0009211 | A1 | 7/2001 | Kobayashi et al. | |
| 2001/0045326 | A1 * | 11/2001 | Gottlieb et al. | 187/254 |
| 2003/0188930 | A1 * | 10/2003 | Lauch | 187/264 |
| 2005/0178621 | A1 * | 8/2005 | Kawasaki et al. | 187/254 |

FOREIGN PATENT DOCUMENTS

| | | |
|---|---|---|
| EP | 0 631 967 B2 | 9/2004 |

* cited by examiner

ELEVATOR

This application is a continuation of, and claims priority under 35 U.S.C. §120 and 35 U.S.C. §365(c) from, PCT International Application No. PCT/FI2003/000818 which has an International filing date of Nov. 4, 2003, which designated the United States of America, PCT International Application No. PCT/FI03/00714, which has an International filing date of Oct. 1, 2003, FINLAND Application Priority Number 20030153 filed Jan. 31, 2003 and FINLAND Application Priority Number 20021959 filed Nov. 4, 2002 the entire contents of all of which are hereby incorporated herein by reference.

Example embodiments relates to an elevator, more specifically, an elevator without a counterweight.

BACKGROUND

One of the objectives in elevator development work is to achieve efficient and economical utilization of building space. In recent years, this development work has produced various elevator solutions without machine room, among other things. Good examples of elevators without machine room are disclosed in specifications EP 0 631 967 (A1) and EP 0 631 968. The elevators described in these specifications are fairly efficient in respect of space utilization as they have made it possible to eliminate the space required by the elevator machine room in the building without a need to enlarge the elevator shaft. In the elevators disclosed in these specifications, the machine is compact at least in one direction, but in other directions it may have much larger dimensions than a conventional elevator machine.

In these basically good elevator solutions, the space required by the hoisting machine limits the freedom of choice in elevator lay-out solutions. Space is needed for the arrangements required for the passage of the hoisting ropes. It is difficult to reduce the space required by the elevator car itself on its track and likewise the space required by the counterweight, at least at a reasonable cost and without impairing elevator performance and operational quality. In a traction sheave elevator without machine room, mounting the hoisting machine in the elevator shaft is often difficult, especially in a solution with machine above, because the hoisting machine is a sizeable body of considerable weight. Especially in the case of larger loads, speeds and/or hoisting heights, the size and weight of the machine are a problem regarding installation, even so much so that the required machine size and weight have in practice limited the sphere of application of the concept of elevator without machine room or at least retarded the introduction of said concept in larger elevators. In modernization of elevators, the space available in the elevator shaft often limits the area of application of the concept of elevator without machine room. In many cases, especially when hydraulic elevators are to be modernized or replaced, it is not practical to apply the concept of roped elevator without machine room due to insufficient space in the shaft, especially in a case where the hydraulic elevator solution to be modernized/replaced has no counterweight. A disadvantage with elevators provided with a counterweight is the cost of the counterweight and the space it requires in the shaft. Drum elevators, which are nowadays rarely used, have the drawbacks of heavy and complex hoisting machines with a high power/torque requirement. Prior-art elevator solutions without counterweight are exotic, and no adequate solutions are known. Before, it has not been technically or economically reasonable to make elevators without a counterweight. One solution of this type is disclosed in specification WO9806655. A recent elevator solution without counterweight presents a viable solution. In prior-art elevator solutions without counterweight, the tensioning of the hoisting rope is implemented using a weight or spring, and this is not an attractive approach to implementing the tensioning of the hoisting rope. Another problem with elevator solutions without counterweight, when long ropes are used e.g. due to a large hoisting height or a large rope length required by high suspension ratios, is the compensation of the elongation of the ropes and the fact that, due to rope elongation, the friction between the traction sheave and the hoisting ropes is insufficient for the operation of the elevator. In a hydraulic elevator, especially a hydraulic elevator with lifting force applied from below, the shaft efficiency, in other words the ratio of the cross-sectional shaft area occupied by the elevator car to the total cross-sectional area of the elevator shaft, is fairly high. This has traditionally been a significant factor contributing towards the choice of a hydraulic elevator as the elevator solution for a building. On the other hand, hydraulic elevators have many drawbacks associated with their lifting mechanism and oil consumption. Hydraulic elevators consume plenty of energy, possible oil leakages from the elevator equipment is an environmental risk, the required periodic oil changes constitute a large cost item, even an elevator installation in good repair produces unpleasant smell as small amounts of oil escape into the elevator shaft or machine room and from there further into other parts of the building and into the environment and so on. Because of the shaft efficiency of the hydraulic elevator, its modernization by replacement with another type of elevator that would obviate the drawbacks of a hydraulic elevator while necessarily involving the use of a smaller elevator car is not an attractive solution to the owner of the elevator. Also, the small machine spaces of hydraulic elevators, which may be located at a large distance from the elevator shaft, make it difficult to change the elevator type.

There are a very large number of traction sheave elevators installed and in use. Such traction sheave elevators were built in their time in accordance with the users' needs as conceived at the time and the intended uses of the buildings in question. Afterwards, both users' needs and the uses of the buildings have changed in many cases, and an old traction sheave elevator may have proved to be insufficient in respect of car size or otherwise. For example, older and relatively small elevators are not necessarily suited for the transportation of prams or wheelchairs. On the other hand, in older buildings which have been converted from residential use for office or other uses, a smaller elevator installed in its time is no longer sufficient in respect of capacity. As is known, enlarging such a traction sheave elevator is practically impossible because the elevator car and the counterweight already take up the cross-sectional area of the elevator shaft and there is no reasonable way of enlarging the car.

SUMMARY

The object of the invention in general is to achieve at least one of the following objectives. On the one hand, it is an aim the invention to develop the elevator without machine room further so as to allow more effective space utilization in the building and elevator shaft than before. This means that the elevator must be so constructed that it can be installed in a fairly narrow elevator shaft if necessary. One objective is to achieve an elevator in which the hoisting rope has a good grip/contact on the traction sheave. Yet another objective is to achieve an elevator solution without counterweight without compromising the properties of the elevator. A further objective is to eliminate the adverse effects of rope elongations.

Another object of the invention is to enable the bottom and top spaces of the elevator shaft to be more effectively utilized by elevators without counterweight.

The object of the invention should be achieved without compromising the possibility of varying the basic elevator layout.

The elevator of the invention is characterized by what is disclosed in the characterization part of claim 1. Other embodiments of the invention are characterized by what is disclosed in the other claims. Inventive embodiments are also discussed in the description section of the present application. The inventive content of the application can also be defined differently than in the claims below. The inventive content may also consist of several separate inventions, especially if the invention is considered in the light of expressions or implicit sub-tasks or from the point of view of advantages or categories of advantages achieved. Therefore, some of the attributes contained in the claims below may be superfluous from the point of view of separate inventive concepts.

By applying the invention, one or more of the following advantages, among others, can be achieved:

- in the elevator of the invention, no separate steel structures reducing the shaft top space are needed at the top and bottom ends of the elevator shaft
- the invention allows elevator installation times and the total installation costs to be reduced
- at the lower end of the elevator shaft, no space is needed under the elevator car for rope sheaves or other devices required for suspension, and consequently the pit at the bottom of the elevator shaft can be made shallow
- in the elevator of the invention, there are no rope portions running upwards or downwards nor any diverting pulleys in the spaces directly above and below the elevator car, because the transverse portions of the hoisting ropes run in the elevator car, which allows the top and bottom shaft space required by the elevator to be made shallow
- in the elevator of the invention, the transverse rope portions have been arranged in the elevator car, preferably inside a transverse beam comprised in the elevator car, thus avoiding transverse passages of the hoisting ropes in the upper or lower parts of the shaft, which allows the top and bottom shaft space required by the elevator to be made shallow
- n the elevator of the invention, the transverse rope portions have been arranged in the elevator car, preferably inside a transverse beam comprised in the elevator car, thus avoiding transverse passages of the hoisting ropes in the upper or lower parts of the shaft, with the result that the transverse forces of the rope tension act within the car structure, which makes it unnecessary to provide any separate supporting arrangements regarding diverting pulleys or the hoisting machine in the upper and/or lower part of the elevator shaft
- applying the invention results in effective utilization of the cross-sectional area of the elevator shaft
- Although the invention is primarily intended for use in elevators without machine room, it can also be applied for use in elevators having a machine room. As shown in FIG. 4. for example, drive machine 4, seventh diverting pulley 9, and traction sheave 10 may be disposed in machine room 40.
- the suspension of the car can be implemented using almost any appropriate suspension ratio above and below the elevator car, yet preferably using even suspension ratios above and below the elevator car
- Preferred suspension ratios according to the invention above and below the elevator car are 2:1, 6:1, 10:1 etc.
- the invention allows symmetrical suspension of the elevator car
- installation and maintenance of the diverting pulleys of the elevator are easy to implement as these are fixed in place by means of mounting elements
- the invention makes it easy to implement the installation of the hoisting machine.

The primary area of application of the invention is elevators designed for the transportation of people and/or freight. A typical area of application of the invention is in elevators whose speed range is about 1.0 m/s or below but may also be higher. For example, an elevator having a traveling speed of 0.6 m/s is easy to implement according to the invention.

In the elevator of the invention, normal elevator hoisting ropes, such as generally used steel wire ropes, are applicable. In the elevator, it is possible to use ropes made of artificial materials and ropes in which the load-bearing part is made of artificial fiber, such as e.g. so-called "aramid ropes", which have recently been proposed for use in elevators. Applicable solutions also include steel-reinforced flat ropes, especially because they allow a small deflection radius. Particularly well applicable in the elevator of the invention are elevator hoisting ropes twisted e.g. from round and strong wires. From round wires, the rope can be twisted in many ways using wires of different or equal thickness. In ropes well applicable in the invention, the wire thickness is below 0.4 mm on an average. Well applicable ropes made from strong wires are those in which the average wire thickness is below 0.3 mm or even below 0.2 mm. For instance, thin-wired and strong 4 mm ropes can be twisted relatively economically from wires such that the mean wire thickness in the finished rope is in the range of 0.15 . . . 0.25 mm, while the thinnest wires may have a thickness as small as only about 0.1 mm. Thin rope wires can easily be made very strong. In the invention, rope wires having a strength greater than about 2000 N/mm$^2$ can be used. A suitable range of rope wire strength is 2300-2700 N/mm$^2$. In principle, it is possible to use rope wires having a strength of up to about 3000 N/mm$^2$ or even more.

By increasing the contact angle by means of a rope sheave serving as a diverting pulley, the grip-between the traction sheave and the hoisting ropes can be increased. A contact angle exceeding 180° between the traction sheave and the hoisting rope is achieved by utilizing a diverting pulley or diverting pulleys. In this way, the weight as well as the size on the elevator car can be reduced, thereby increasing the space saving potential of the elevator.

The elevator of the invention is traction sheave elevator without counterweight, in which elevator the elevator car is guided by elevator guide rails and suspended by means of diverting pulleys on hoisting ropes in such manner that the elevator has rope portions of the hoisting ropes going upwards and downwards from the elevator car. The elevator comprises a number of diverting pulleys in the upper and lower parts of the elevator shaft. The elevator has a drive machine placed in the elevator shaft and provided with a traction sheave. The elevator comprises a compensating device acting on the hoisting ropes for equalizing and/or compensating the rope tension and/or rope elongation. Diverting pulleys are mounted on the elevator car near two side walls. In the elevator of the invention, the rope portions from the diverting pulleys in the lower part of the elevator shaft and the rope portions from the diverting pulleys in the upper part of the elevator shaft to the diverting pulleys mounted on the elevator car extend in a substantially vertical direction. In the elevator, the rope portions connecting the rope portions from one side of the elevator car to its other side are rope portions between the diverting pulleys mounted near different side walls on the elevator car.

BRIEF DESCRIPTION OF THE DRAWINGS

In the following, the invention will be described in detail by the aid of a few embodiment examples with reference to the attached drawings, wherein.

DETAILED DESCRIPTION OF EXAMPLE EMBODIMENTS

Figure 1:
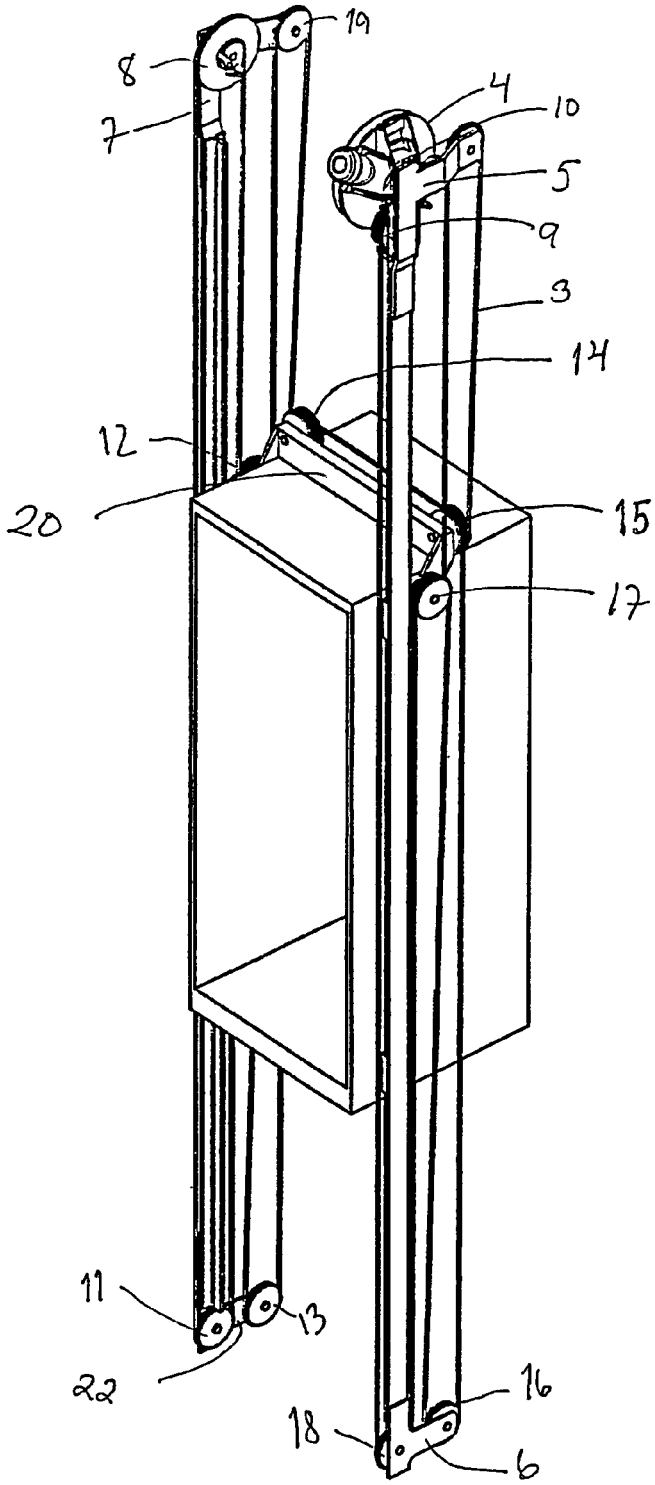
FIG. 1 presents an elevator according to the invention in diagrammatic form.
Figure 2:
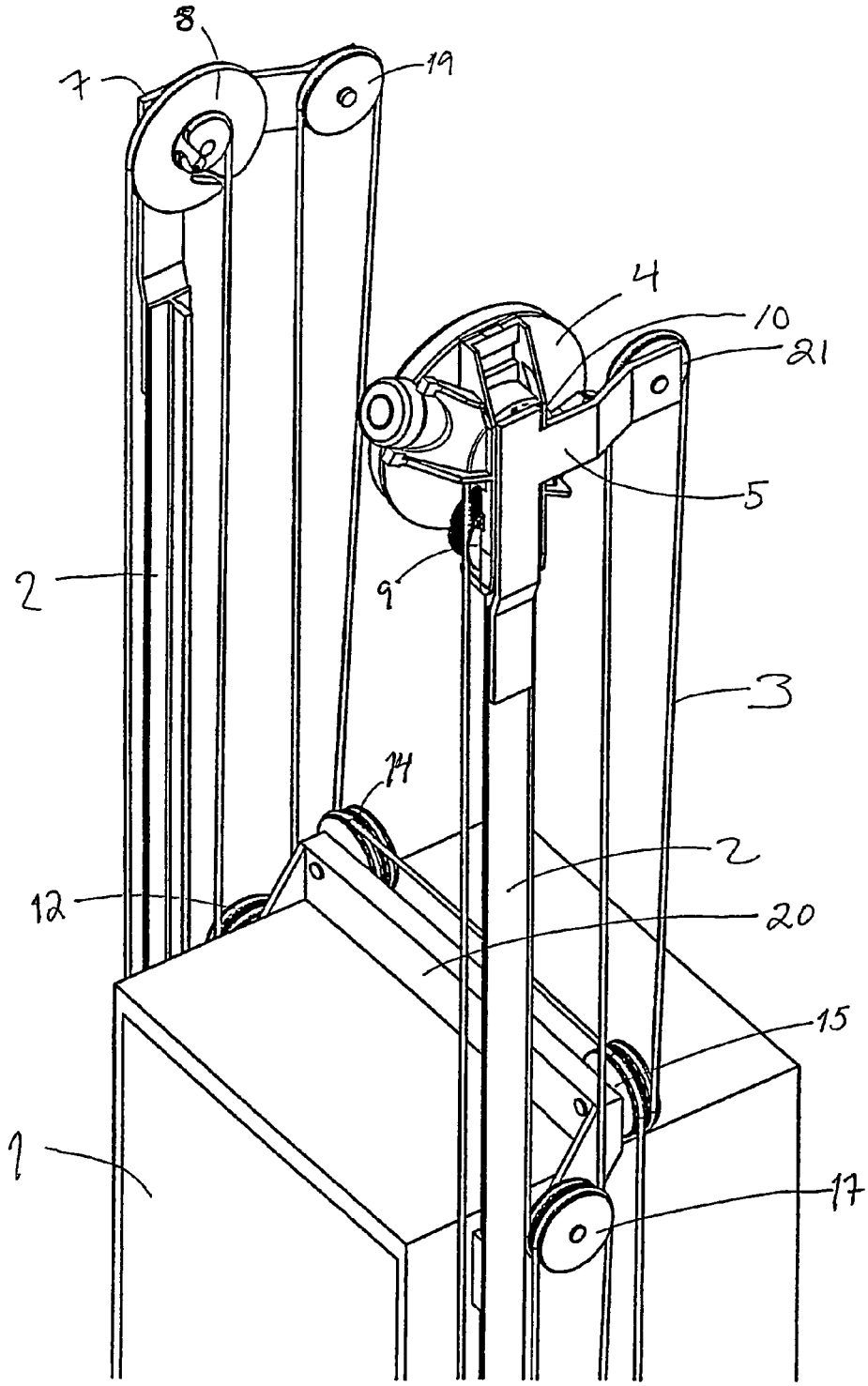
FIG. 2 presents an elevator according to the invention and FIG. 1 as seen from another angle.
Figure 3:
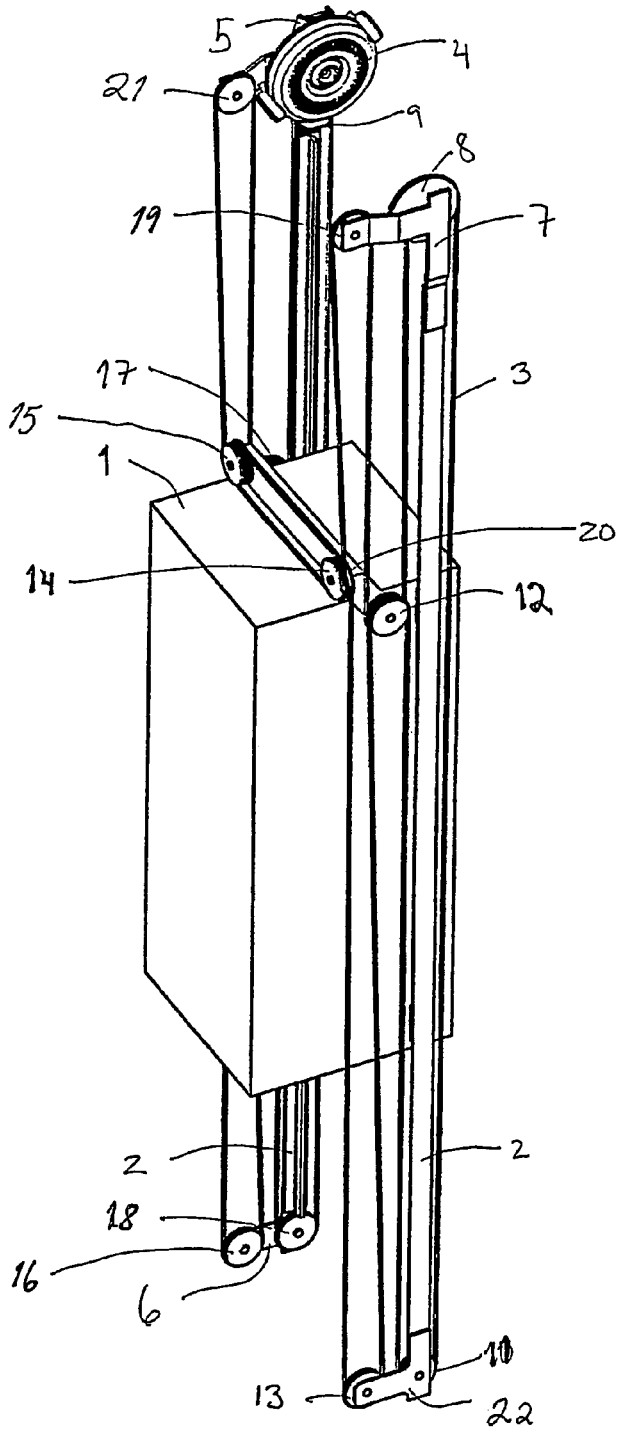
FIG. 3 presents an elevator according to the invention and FIG. 1 as seen from a third angle.
Figure 4:
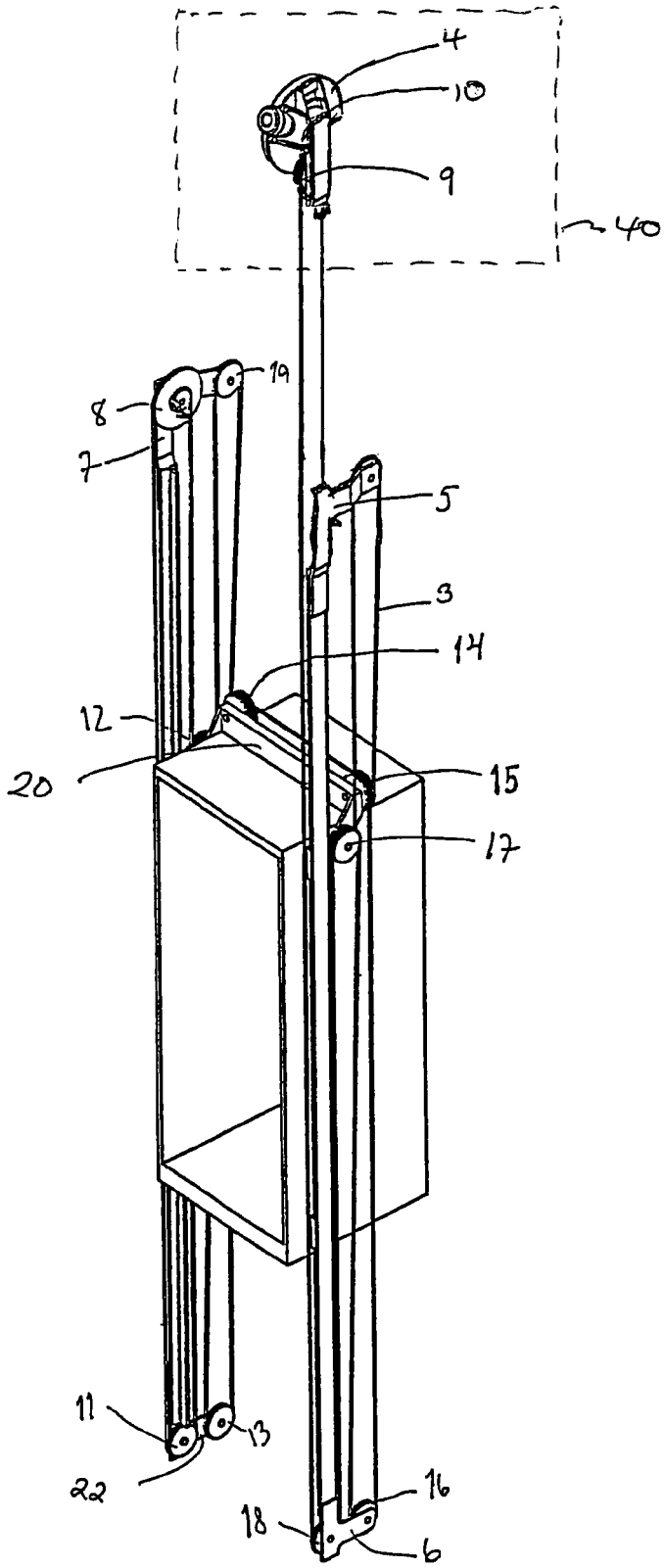
FIG. 4 presents an elevator comprising a hoisting machine disposed in a machine room according to the invention in diagrammatic form.

FIGS. 1, 2 and 3 present a diagrammatic illustration of the structure of an elevator according to the invention. The elevator is preferably an elevator without machine room, with a drive machine 4 placed in an elevator shaft. The elevator shown in the figure is a traction sheave elevator without counterweight and with machine above. The elevator comprises an elevator car 1 moving along guide rails 2. In FIGS. 1, 2 and 3, the passage of the hoisting ropes may be as follows. One end of the hoisting ropes may be fastened to a sheave of a smaller diameter included in a compensating sheave system serving as a compensating device 8. The sheave may immovably fixed to a second sheave of a larger diameter included in the compensating sheave system 8. This compensating sheave system 8 functioning as a compensating device 8 may be fitted to the elevator shaft via a supporting element 7 immovably fixed to an elevator guide rail 2. From the smaller-diameter sheave of the compensating sheave system 8, the hoisting ropes 3 go downwards and meet a diverting pulley 12 mounted on a beam 20 fitted in place on the elevator car, preferably in the upper part on the elevator car, passing around the diverting pulley 12 along its rope grooves. In the rope sheaves used as diverting pulleys, these rope grooves may be coated or uncoated, e.g. with a friction increasing material1 such as polyurethane or some other material suited to the purpose. From diverting pulley 12, the ropes go further upwards to a diverting pulley 19 in the elevator shaft, the diverting pulley 19 being mounted on a supporting element 7 which supports it on an elevator guide rail 2. Having passed around diverting pulley 19, the hoisting ropes go further downwards to a diverting pulley 14 which is also mounted on the beam 20 fitted in place on the elevator car, preferably in the upper part on the elevator car. Having passed around diverting pulley 14, the ropes go transversely with respect to the elevator shaft and elevator car to a diverting pulley 15 mounted on the same beam 20 on the other side on the elevator car, and after passing around diverting pulley 15, the hoisting ropes go further upwards to a diverting pulley 21 fixed in place in the upper part of the elevator shaft. This diverting pulley 21 is fitted in place on a supporting element 5. Via the supporting element 6, the diverting pulley 21 is supported on the elevator guide rails 2. Having passed around diverting pulley 21, the hoisting ropes go further downwards to a diverting pulley 17 on the elevator car 1, which diverting pulley 17 is also fitted in place on the beam 20. Having passed around diverting pulley 17, the hoisting ropes go further upwards to a diverting pulley 9 which is preferably fixed in place near the hoisting machine 4. The roping arrangement between diverting pulley 9 and the traction sheave 10 as presented in the figure is Double Wrap (DW) roping. From diverting pulley 9, the hoisting ropes go further to the traction sheave 10, having first passed via diverting pulley 9 in "tangential contact" with it. This means that the ropes 3 going from the traction sheave 10 to the elevator car 1 pass via the rope grooves of diverting pulley 9 and the deflection of the rope 3 caused by the diverting pulley 9 is very small. It could be said that the ropes 3 coming from the traction sheave 10 only touch the diverting pulley 9 tangentially. Such tangential contact serves as a solution damping the vibrations of the outgoing ropes and it can be applied in other roping solutions as well. The hoisting ropes are passed over the traction sheave 10 of the hoisting machine 4 along the rope grooves of the traction sheave 10. From the traction sheave 10, the ropes 3 go further downwards to diverting pulley 9, passing around it along the rope grooves of the diverting pulley 9, whereupon the ropes return back to the traction sheave 10 and pass around it along the rope grooves of the traction sheave. From the traction sheave 10, the ropes 3 go further downwards in "tangential contact" with diverting pulley 9 past the elevator car 1 moving along the guide rails 2, to a diverting pulley 18 located in the bottom part of the elevator shaft. The hoisting machine and diverting pulley 9 are fixed in place on a supporting element 5, which again is supported on the elevator guide rails 2. Diverting pulleys 12, 19, 14, 15, 21, 17, 9 and the sheave of smaller diameter in the compensating sheave system 8 together with the traction sheave 10 of the hoisting machine 4 form the suspension above the elevator car, which has the same suspension ratio as the suspension below the elevator car, this suspension ratio being 6:1in FIGS. 1, 2 and 3. The hoisting ropes pass around diverting pulley 18 along its rope grooves, the pulley 18 being preferably fitted in place in the lower part of the elevator shaft on a supporting element 6 fixed in place on a car guide rail 2. Having passed around the diverting pulley 18, the hoisting ropes 3 go further upwards to a diverting pulley 17 fitted in place on the elevator car, the pulley 17 being mounted on the beam 20, and having passed around this diverting pulley 17, the ropes go further downwards to a diverting pulley 16 mounted in place on the supporting element 6 in the lower part of the elevator shaft. Having passed around the diverting pulley 16, the ropes return to a diverting pulley 15 fitted in place on the elevator car, this diverting pulley 15 being mounted on the beam 20. From diverting pulley 15, the hoisting ropes 3 go further transversely across the elevator car to diverting pulley 14 mounted on the beam 20 on the other side of the elevator car, and having passed around pulley 14 the ropes go further downwards to a diverting pulley 13 fitted in place in the lower part of the elevator shaft. The pulley 13 being mounted on in place on a supporting element 22, which supporting element 22 in turn is fixed in place on an elevator guide rail 2. Having passed around diverting pulley 13, the ropes go further upwards to diverting pulley 12 fitted in place on the elevator car and mounted on the beam 20. Having passed around diverting pulley 12, the ropes 3 go further downwards to a diverting pulley 11 fixed in place in the lower part of the shaft, the pulley 11 being mounted on supporting element 22. Having passed around diverting pulley 11, the hoisting ropes 3 go further upwards to the compensating sheave system 8 mounted in place in the upper part of the elevator shaft. The second end of the hoisting rope being secured to the one of the sheaves of the compensating sheave system 8 that is larger in diameter. The compensating sheave system functioning as a compensating device 8 is fixing devices on supporting element 7. Diverting pulleys 18, 17, 16, 15, 14, 13, 19, 11 and the sheave of larger diameter included in the compensating sheave system 8 form the suspension below the elevator car with the same suspension ratio as in the suspension above the elevator car. The suspension ratio being 6:1 in FIGS. 1, 2 and 3.

In FIGS. 1, 2 and 3, the compensating sheave system 8 consists of two wheel-like bodies, preferably sheaves, immovably fastened to each other and differing in diameter, said compensating sheave system 8 being fitted in place on supporting element 7, which supporting element 7 is mounted in place on the elevator guide rails 2 of the wheel-like bodies, the sheave engaging the hoisting rope portion below the elevator car has a diameter larger than the diameter of the sheave engaging the hoisting rope portion above the elevator car. The diameter ratio between the diameters of the sheaves of the compensating sheave system determines the magnitude of the tensioning force acting on the hoisting rope and therefore also the rope elongation compensating force and likewise the magnitude of the rope elongation to be compensated. The use of a compensating sheave system 8 provides the advantage that the structure compensates even very large rope elongations. By varying the diametric size of the sheaves in the compensating sheave system 8, it is possible to influence the magnitude of the rope elongation to be compensated and the ratio between the rope forces $T_1$ and $T_2$ acting on the traction sheave, which ratio can be rendered constant by this arrangement. Due to a large suspension ratio or a large hoisting height, the length of the rope used in the elevator is large. For the operation and safety of the elevator, it is essential that the hoisting rope portion below the elevator car be kept under a sufficient tension and that the amount of rope elongation to be compensated be large. Often this can not be implemented using a spring or a simple lever. With odd suspension ratios above and below the elevator car, the compensating sheave system functioning as a compensating device in the elevator illustrated in FIGS. 1, 2 and 3 is fitted in place on the elevator car via a transfer gear, and with even suspension ratios the compensating sheave system functioning as a compensating device in the elevator of the invention is fitted in place in the elevator shaft, preferably on the elevator guide rails. In the compensating sheave system 8 according to the invention, it is possible to use two sheaves, but the number of wheel-like bodies used may vary; for example, it is possible to use only one sheave with locations fitted for hoisting rope fixing points differing in diameter. It is also possible to use more than two sheaves e.g. to allow the diameter ratio between the sheaves to be varied by only changing the diameter of the sheaves in the compensating sheave system. The elevator without counterweight presented in FIGS. 1, 2 and 3 has not traditional rope force compensating springs; instead, the compensator consists of a compensating sheave system 8. Therefore, the hoisting ropes 3 can be secured directly to the compensating sheave system 8. Besides a compensating sheave system as presented in the figures, the compensating device of the invention may also consist of a lever or other compensating device suited to the purpose, comprising a number of compensating sheaves. The beam 20 presented in the figures, which is fixing devices in conjunction with the elevator car, may also be disposed in some other place than above the elevator car as shown in the figures. The beam may also be placed e.g. below the elevator car or somewhere between. The diverting pulleys may have several grooves and the same diverting pulley may be used to control the passage of both hoisting ropes comprised in the suspension above the elevator car and hoisting ropes comprised in the suspension below the elevator car, as is illustrated in the figures e.g. in connection with diverting pulleys 12,14,15,17.

A preferred embodiment of the elevator of the invention is an elevator without machine room and with machine above, in which the drive machine has a coated traction sheave, and which elevator has thin hoisting ropes of a substantially round cross-section. In the elevator, the contact angle between the hoisting ropes and the traction sheave is greater than 180°. The elevator comprises a unit which comprises—fitted in place via a supporting element—a drive machine, a traction sheave and a diverting pulley fitted at a correct angle relative to the traction sheave. The unit is secured to the elevator guide rails. The elevator is implemented without counterweight with a suspension ratio of 6:1. Compensation of rope forces and elongations is implemented using a compensating device according to the invention. The diverting pulleys in the elevator shaft are fitted in place via supporting elements on the elevator guide rails, while the diverting pulleys on the elevator car are all mounted in place on a beam comprised in the elevator car, said beam also forming a structure supporting the elevator car.

It is obvious to the person skilled in the art that different embodiments of the invention are not limited to the examples described above, but that they may be varied within the scope of the claims presented below. For instance, the number of times the hoisting ropes are passed between the upper part of the elevator shaft and the elevator car and between the elevator car and the diverting pulleys below it is not a very decisive question as regards the basic advantages of the invention, although it is possible to achieve some additional advantages by using multiple rope passages. In general, especially applications without counter-weight are so implemented that the ropes go to the elevator car from above as many times as from below, so that the suspension ratios of diverting pulleys going upwards and diverting pulleys going downwards are the same. It is obvious to the skilled person that an embodiment of the invention can also be implemented with odd suspension ratios above and below the elevator car, in which case the compensating device is mounted on the elevator car or its structures. In accordance with the examples described above, the skilled person can vary the embodiment of the invention, while the traction sheaves and rope pulleys, instead of being coated metal pulleys, may also be uncoated metal pulleys or uncoated pulleys made of some other material suited to the purpose.

It is further obvious to the person skilled in the art that the traction sheaves and rope pulleys of metallic or some other appropriate material that are used in the invention, functioning as diverting pulleys and coated with a non-metallic material at least in the area of their grooves, may have a coating made of e.g. rubber, polyurethane or some other material suited to the purpose. It is also obvious to the skilled person that moving the compensating sheave system with respect to the elevator car to the side on the elevator car means that "the side on the elevator car" refers to a movement within the car height, said distance of movement being preferably the entire height of the elevator car.

It is also obvious to the person skilled in the art that the elevator car and the machine unit may be laid out in the cross-section of the elevator shaft in a manner differing from the lay-out described in the examples. Such a different lay-out might be e.g. one in which the machine is located behind the car as seen from the shaft door and the ropes are passed under the car diagonally relative to the bottom of the car. Passing the ropes under the car in a diagonal or otherwise oblique direction relative to the form of the bottom provides an advantage when the suspension of the car on the ropes is to be made symmetrical relative to the center of mass of the elevator in other types of suspension lay-out as well.

It is likewise obvious to the skilled person that an elevator applying the invention may be equipped differently from the examples described above. It is further obvious to the skilled person that the elevator of the invention can be implemented using almost any type of flexible hoisting means as hoisting ropes, e.g. flexible rope of one or more strands, flat belt, cogged belt, trapezoidal belt or some other type of belt applicable to the purpose.

Figure 5:
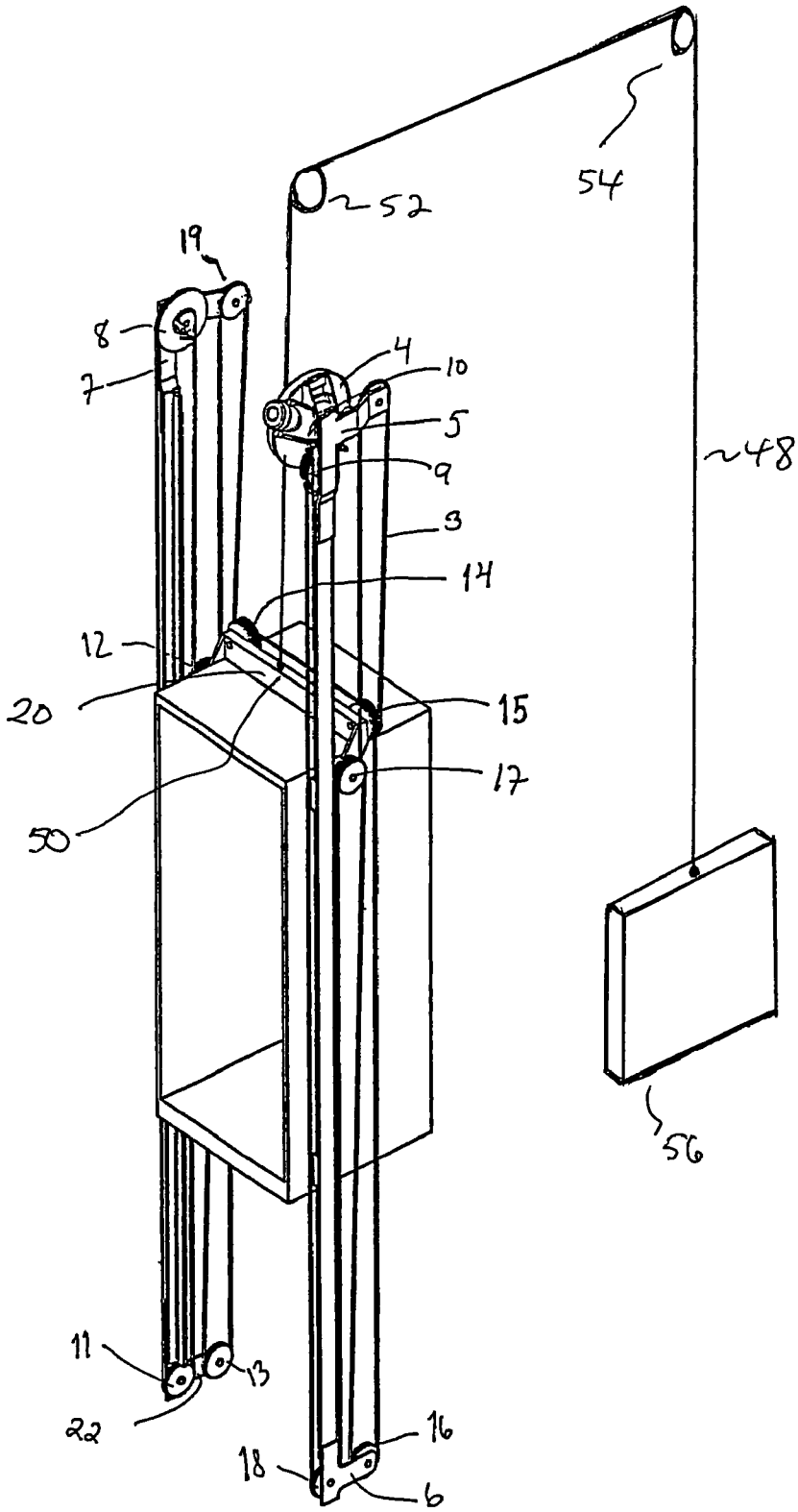
FIG. 5 presents an elevator with counterweight according to the invention in diagrammatic form.

It is also obvious to the person skilled in the art that the elevator of the invention can be implemented using different roping arrangements between the traction sheave and the diverting pulley/diverting pulleys to increase the contact angle than those described as examples. For example, it is possible to dispose the diverting pulley/diverting pulleys, the traction sheaves ,and the hoisting ropes in other ways than in the roping arrangements described in the examples, such as, e.g., by using DW, XW, or CSW roping. It is also obvious to the skilled person that, in the elevator of the invention, the elevator may also be provided with a counterweight, in which case the counterweight has, e.g., a weight below that of the car and is suspended by a separate roping arrangement. As shown in FIG. 5. for example, the elevator may include counterweight rope 48 attached to beam 20 at point 50, twelfth diverting pulley 52, thirteenth diverting pulley 54, and counterweight 56.

The invention claimed is:

1. An elevator without counterweight, comprising:
an elevator car;
elevator car guide rails;
a plurality of diverting pulleys;
a set of hoisting ropes;
a hoisting machine; and
a compensating device;
wherein the elevator car is guided by the elevator car guide rails,
wherein the elevator car is suspended by the plurality of diverting pulleys on the set of hoisting ropes so that the elevator has rope portions of the hoisting ropes going upwards and downwards from the elevator car,
wherein a first set of the diverting pulleys is disposed in an upper part of a shaft of the elevator,
wherein a second set of the diverting pulleys is disposed in a lower part of the elevator shaft,
wherein the hoisting machine is disposed in the elevator shaft,
wherein the hoisting machine is provided with a traction sheave,
wherein the compensating device acts on the hoisting ropes to perform one or more of equalizing elongation of the hoisting ropes, equalizing tension in the hoisting ropes, compensating elongation of the hoisting ropes, and compensating tension in the hoisting ropes,
wherein a third set of the diverting pulleys is disposed on the elevator car near two side walls so that rope portions from the traction sheave, from the first set of the diverting pulleys, and from the second set of the diverting pulleys to the third set of the diverting pulleys extend in a substantially vertical direction, and
wherein a fourth set of the diverting pulleys is disposed on the elevator car near a top surface of the elevator car so that rope portions running from a first side of the elevator car to a second side of the elevator car extend between the fourth set of the diverting pulleys.

2. The elevator of claim 1, wherein the first set of the diverting pulleys are supported on the elevator car guide rails by supporting elements.

3. The elevator of claim 1, wherein the hoisting machine is supported on one of the elevator car guide rails by a supporting element shared by at least one of the diverting pulleys.

4. The elevator of claim 1, wherein in the third set of the diverting pulleys, at least one diverting pulley near each of the two side walls is mounted on a horizontal beam structure for reinforcing, supporting, or reinforcing and supporting the elevator car.

5. The elevator of claim 1, wherein a roping arrangement used between the traction sheave and one of the diverting pulleys is double wrap ("DW") roping.

6. The elevator of claim 1, wherein the second set of the diverting pulleys are supported on the elevator car guide rails by supporting elements.

7. The elevator of claim 1, wherein the compensating device includes at least one of a lever, a tensioning sheave system, and a compensating sheave system.

8. The elevator of claim 1, wherein the compensating device includes one or more of the diverting pulleys.

9. The elevator of claim 1, wherein a continuous contact angle between the traction sheave and the hoisting ropes is greater than or equal to 180°.

10. The elevator of claim 1, wherein the hoisting ropes have high-strength properties.

11. The elevator of claim 1, wherein the hoisting ropes have diameters less than or equal to about 8 mm.

12. The elevator of claim 1, wherein the hoisting machine weighs less than a nominal load of the elevator.

13. The elevator of claim 1, wherein the traction sheave is coated with at least one of a polyurethane, a rubber, and some other frictional material suited to the purpose.

14. The elevator of claim 1, wherein the traction sheave, at least in an area of rope grooves, is made of metal.

15. The elevator of claim 14, wherein the traction sheave has undercut rope grooves.

16. The elevator of claim 1, wherein a ratio of a diameter of a pulley of the second set of the diverting pulleys to a thickness of the hosting ropes is less than 40:1.

17. The elevator of claim 1, wherein the hoisting ropes have diameters greater than or equal to about 3 mm and less than or equal to about 5 mm.

18. The elevator of claim 1, wherein the traction sheave, at least in an area of rope grooves, is made of cast iron.

19. An elevator without counterweight, comprising:
an elevator car;
elevator car guide rails;
a plurality of diverting pulleys;
a set of hoisting ropes;
a hoisting machine; and
a compensating device;
wherein the elevator car is guided by the elevator car guide rails,
wherein the elevator car is suspended by the plurality of diverting pulleys on the set of hoisting ropes so that the elevator has rope portions of the hoisting ropes going upwards and downwards from the elevator car,
wherein a first set of the diverting pulleys is disposed in an upper part of a shaft of the elevator,
wherein a second set of the diverting pulleys is disposed in a lower part of the elevator shaft,
wherein the hoisting machine is disposed in a machine room,
wherein the hoisting machine is provided with a traction sheave, wherein the compensating device acts on the hoisting ropes to perform one or more of equalizing elongation of the hoisting ropes, equalizing tension in the hoisting ropes, compensating elongation of the hoisting ropes, and compensating tension in the hoisting ropes, wherein a third set of the diverting pulleys is disposed on the elevator car near two side walls so that rope portions from the traction sheave, from the first set of the diverting pulleys, and from the second set of the diverting pulleys to the third set of the diverting pulleys extend in a substantially vertical direction, and wherein a fourth set of the diverting pulleys is disposed on the elevator car near a top surface of the elevator car so that rope portions running from a first side of the elevator car to a second side of the elevator car extend between the fourth set of the diverting pulleys.

20. An elevator with counterweight, comprising:

an elevator car;

elevator car guide rails;

a plurality of diverting pulleys;

a set of hoisting ropes;

a hoisting machine; and a compensating device;

wherein the elevator car is guided by the elevator car guide rails, wherein the elevator car is suspended by the plurality of diverting pulleys on the set of hoisting ropes so that the elevator has rope portions of the hoisting ropes going upwards and downwards from the elevator car, wherein a first set of the diverting pulleys is disposed in an upper part of a shaft of the elevator, wherein a second set of the diverting pulleys is disposed in a lower part of the elevator shaft, wherein the hoisting machine is disposed in the elevator shaft, wherein the hoisting machine is provided with a traction sheave, wherein the compensating device acts on the hoisting ropes to perform one or more of equalizing elongation of the hoisting ropes, equalizing tension in the hoisting ropes, compensating elongation of the hoisting ropes, and compensating tension in the hoisting ropes, wherein a third set of the diverting pulleys is disposed on the elevator car near two side walls so that rope portions from the traction sheave, from the first set of the diverting pulleys, and from the second set of the diverting pulleys to the third set of the diverting pulleys extend in a substantially vertical direction, and wherein a fourth set of the diverting pulleys is disposed on the elevator car near a top surface of the elevator car so that rope portions running from a first side of the elevator car to a second side of the elevator car extend between the fourth set of the diverting pulleys.

* * * * *